US009257797B2

(12) United States Patent
Kuang et al.

(10) Patent No.: US 9,257,797 B2
(45) Date of Patent: Feb. 9, 2016

(54) CABLE ASSEMBLY HAVING AN IMPROVED CIRCUIT BOARD

(71) Applicant: HON HAI PRECISION INDUSTRY CO., LTD., New Taipei (TW)

(72) Inventors: Dong-Qi Kuang, Kunshan (CN); Qing-Man Zhu, Kunshan (CN); Jerry Wu, Irvine, CA (US)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/457,089

(22) Filed: Aug. 11, 2014

(65) Prior Publication Data

US 2015/0044907 A1 Feb. 12, 2015

(30) Foreign Application Priority Data

Aug. 9, 2013 (CN) ..... 2013 1 03452434
Aug. 9, 2013 (CN) ..... 2013 1 03456524
Aug. 9, 2013 (CN) ..... 2013 1 03458784

(51) Int. Cl.

| | |
|---|---|
| ***H01R 13/648*** | (2006.01) |
| ***H01R 13/6594*** | (2011.01) |
| ***H01R 9/03*** | (2006.01) |
| *H01R 13/6581* | (2011.01) |
| *H01R 24/62* | (2011.01) |
| *H01R 13/66* | (2006.01) |

(52) U.S. Cl.

CPC ..... *H01R 13/6594* (2013.01); *H01R 9/038* (2013.01); *H01R 13/6581* (2013.01); *H01R 13/6658* (2013.01); *H01R 24/62* (2013.01)

(58) Field of Classification Search

CPC .. H01R 13/648; H01R 13/652; H01R 13/658; H01R 13/6592

USPC ..... 439/607.22, 660, 76.1

See application file for complete search history.

(56) References Cited

U.S. PATENT DOCUMENTS

| | | | | |
|---|---|---|---|---|
| 6,869,308 | B2 * | 3/2005 | Wu | H01R 12/62 439/497 |
| 7,134,884 | B2 * | 11/2006 | Wang | H01R 13/6658 439/76.1 |
| 7,286,372 | B2 | 10/2007 | Finisar | |
| 7,306,479 | B1 * | 12/2007 | Wu | H01R 9/034 439/497 |
| 7,534,141 | B1 | 5/2009 | Hon Hai | |
| 7,632,155 | B1 * | 12/2009 | Wu | H01R 9/035 439/497 |
| 7,651,379 | B1 | 1/2010 | Hon Hai | |
| 7,909,632 | B2 * | 3/2011 | Wu | H01R 9/03 439/353 |
| 7,909,654 | B2 * | 3/2011 | He | H01R 13/6658 439/607.22 |
| 7,914,337 | B1 * | 3/2011 | Li | H01R 9/03 439/660 |
| 8,002,572 | B2 | 8/2011 | Luxi | |
| 8,011,950 | B2 * | 9/2011 | McGrath | H01R 12/594 439/497 |

(Continued)

*Primary Examiner* — Abdullah Riyami
*Assistant Examiner* — Vladimir Imas
(74) *Attorney, Agent, or Firm* — Wei Te Chung; Ming Chieh Chang

(57) ABSTRACT

A cable assembly (100) includes a cover (8) defining an outer cavity (822), a shielding cage (7) defining an inner cavity (712) and being mounted into the outer cavity, an inner board (20) assembled in said inner cavity, and a cable (5) assembled onto the inner board. The inner board includes a top surface (38), a bottom surface (37) and two side surfaces (31). The side surface has a first ground pad (310) adapted to connect with the shielding cage, the bottom surface has a second ground pad (33) adapted to connect with the cable, and the top surface has a third ground pad (343) adapted to connect with the cable.

20 Claims, 8 Drawing Sheets

(56) References Cited

U.S. PATENT DOCUMENTS 8,066,532 B2 * 11/2011 Hou ..... H01R 13/6658 439/660
8,109,797 B2 2/2012 Hon Hai
8,152,568 B2 * 4/2012 Wu ..... H01R 13/6658 439/353
8,298,009 B2 * 10/2012 Elkhatib ..... H01R 12/594 439/581
8,523,610 B2 * 9/2013 Kuster ..... H01R 27/00 439/607.01
8,608,504 B2 * 12/2013 Tseng ..... H01R 9/034 439/326
8,696,388 B2 4/2014 Apple
8,708,752 B2 * 4/2014 Wu ..... H01R 9/032 439/660
8,777,666 B2 * 7/2014 Golko ..... H01R 13/6594 439/607.34
8,864,518 B2 * 10/2014 Ming ..... H05K 1/0213 439/541.5
8,866,696 B2 * 10/2014 Kazanchian ..... H01Q 1/405 343/702
8,870,598 B2 * 10/2014 Qi ..... H01R 13/6581 439/620.03
9,059,543 B2 * 6/2015 Wu ..... H01R 13/652 1/1
2014/0220822 A1 * 8/2014 Keyser ..... H01R 13/6595 439/607.46

* cited by examiner

CABLE ASSEMBLY HAVING AN IMPROVED CIRCUIT BOARD

BACKGROUND OF THE INVENTION

1. Field of the Invention

The present invention relates to a cable assembly, and more particularly to a cable assembly having an improved printed circuit board mounted therein.

2. Description of Related Art

It is known to provide a metal cage in an electrical connector for reducing EMI (Electromagnetic Interference) emissions. U.S. Pat. No. 8,002,572, issued to Lu et al. on Aug. 23, 2011, discloses a cable end connector having an internal PCB (Printed Circuit Board), a metal cage, and a cable soldered onto the PCB. The cable has a number of ground wires soldered to the PCB. Another prior art, U.S. Pat. No. 7,286,372, issued to Aronson et al. on Oct. 23, 2007, discloses a housing formed by top and bottom housing portions and an internal PCB in the housing portions. A conductive band or strip is formed around the surface, and in connection with electrical bias, of the PCB to further facilitate reliable electrical connection between the top housing portion and the bias and between the bottom housing portion and the bias. This conductive band or strip is particularly useful in establishing a reliable electrical connection with springs or foam EMI gaskets that can be used with the top and bottom housing portions.

Hence, a cable assembly having an improved grounding structure in its internal PCB is desired.

SUMMARY OF THE INVENTION

Accordingly, an object of the present invention is to provide a cable assembly comprising: a cover including a top cover and a bottom cover coupled together and defining an outer cavity therebetween; a shielding cage including a top cage and a bottom cage coupled together and defining an inner cavity therebetween, said shielding cage mounted into the outer cavity and having a mating port exposed out of the cover; an inner board mounted into the inner cavity, said inner board having a front portion, a rear portion opposite to the front portion, a top surface, a bottom surface, and two side surfaces, said top surface having a plurality of first pads adjacent to the rear portion, said bottom surface having a plurality of second pads adjacent to the rear portion, and one of said side surfaces having a first ground pad thereon; a cable having a jacket and a plurality of wires shrouded by the jacket, each wire having an outer coat and a conductor partially exposed out of the outer coat, said wires including a plurality of power wires soldered to the first pads, and a plurality of differential signal wires soldered to the second pads; and a resilient rib inwardly extending from one of the top cage and the bottom cage, said resilient rib resiliently and electrically contacting with the first ground pad.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
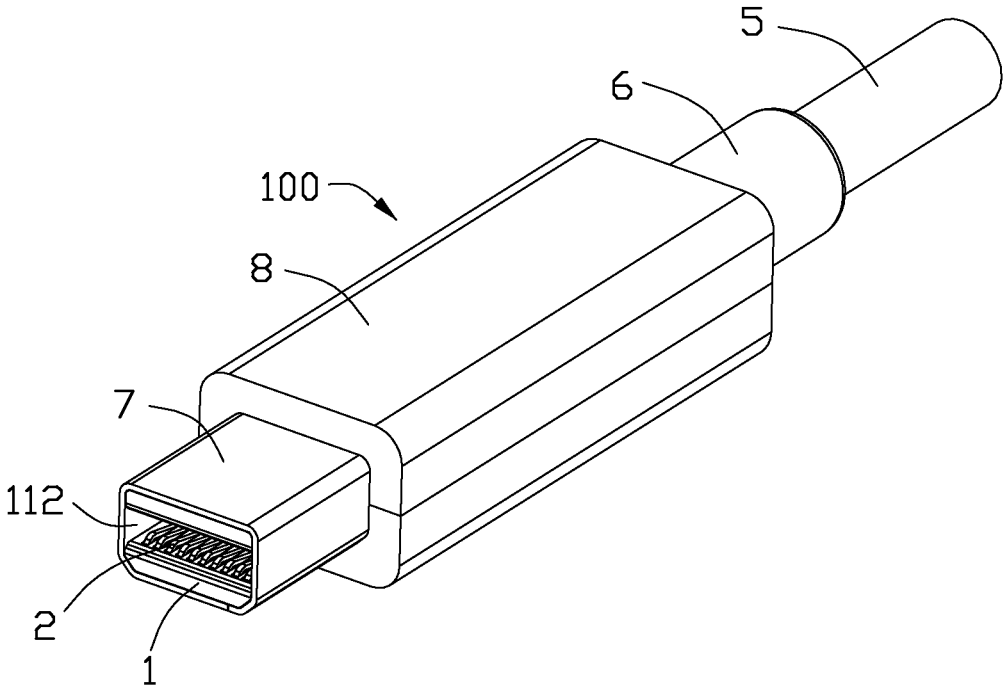
FIG. 1 is an assembled perspective view showing a cable assembly constructed in accordance with the present invention.
Figure 2:
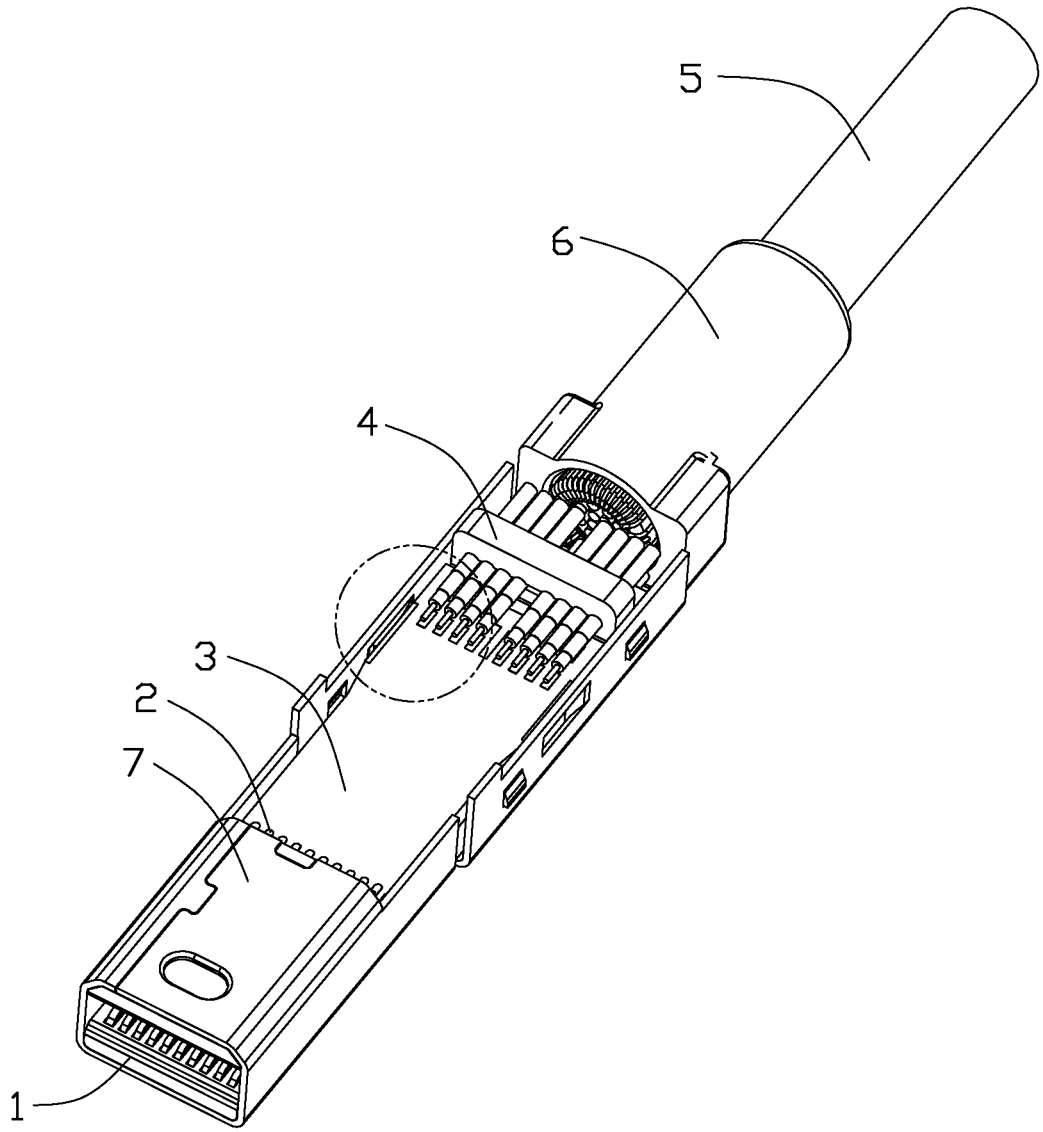
FIG. 2 is a partially exploded perspective view showing the cable assembly as shown in FIG. 1.

Referring to FIGS. 1 and 2, a cable assembly 100 comprises a cover 8, a shielding cage 7 mounted into the cover 8, an inner board 3 assembled into the shielding cage 7, a cable 5 soldered onto the inner board 3, a contact module 10 assembled to the inner board 3 opposing the cable 5, a stabilizer 4 adapted to organize the cable 5, and a boot 6 molded on an end of the cable 5 and partially assembled into the cover 8 for releasing the stress coming from the other side of the cable 5. The shielding cage 7 has a mating port 71 exposed out of the cover 8. The mating port 71 is adapted for mating with a plug connector (not shown).

Figure 3:
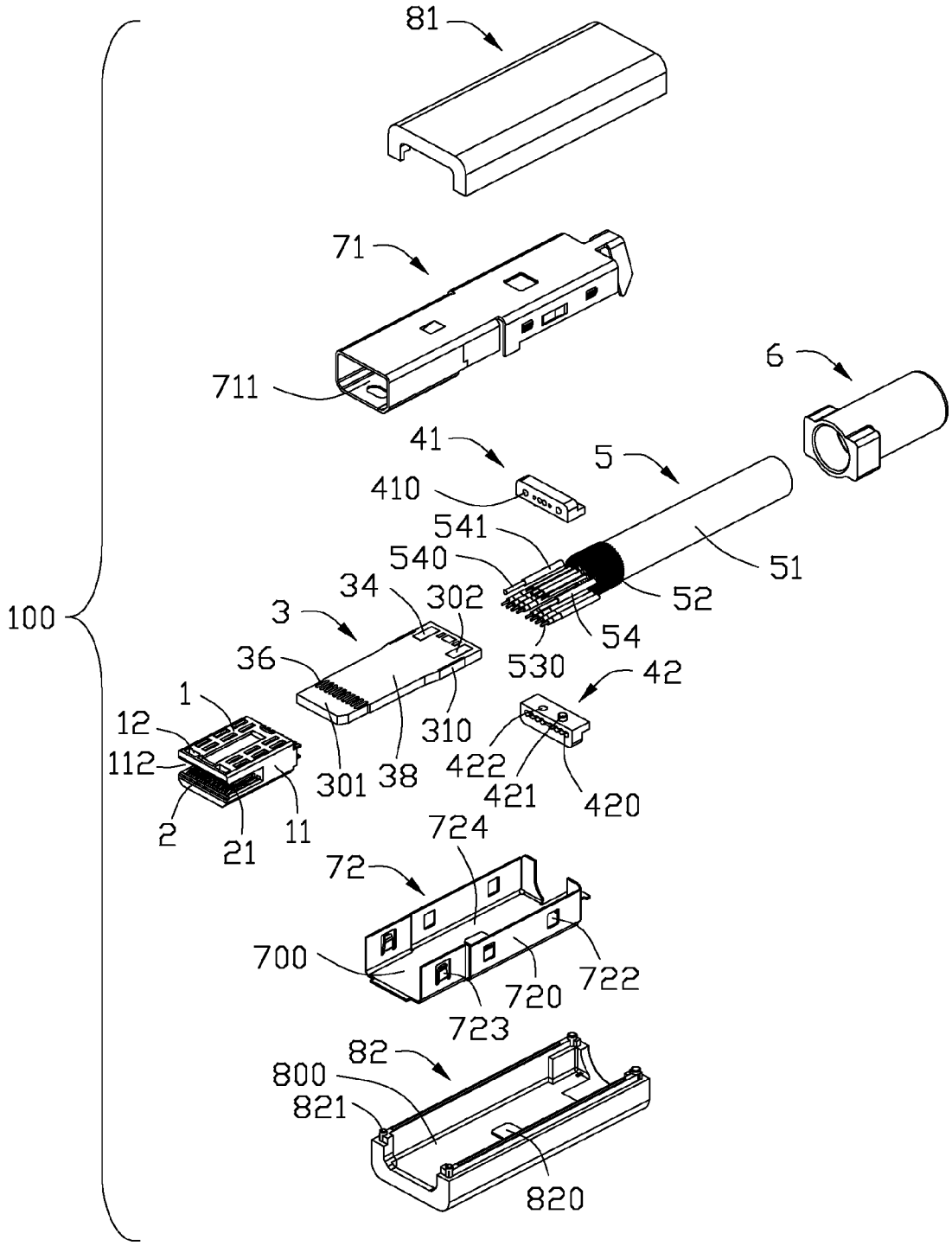
FIG. 3 is an exploded perspective view showing the cable assembly as shown in FIG. 1.
Figure 4:
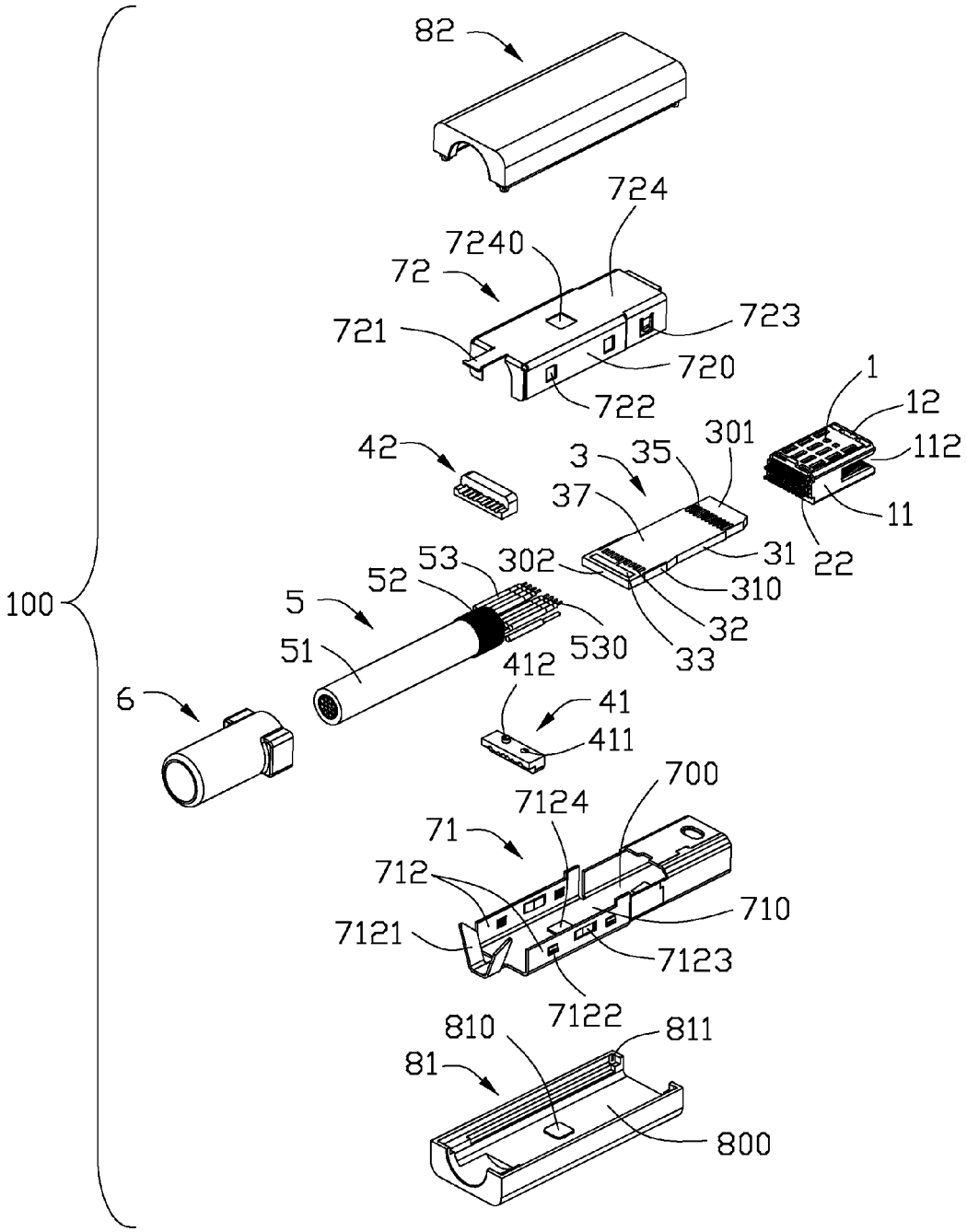
FIG. 4 is another exploded perspective view of the cable assembly shown in FIG. 3.
Figure 5:
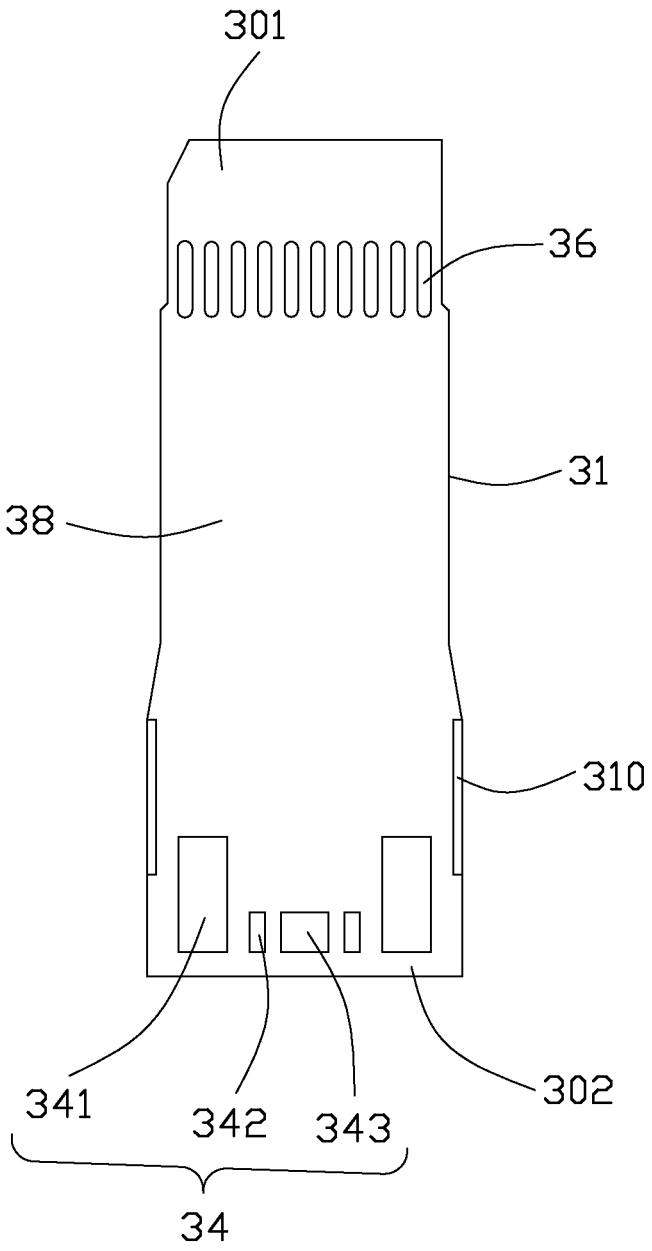
FIG. 5 is a top view showing an inner board of the cable assembly as shown in FIG. 3.
Figure 6:
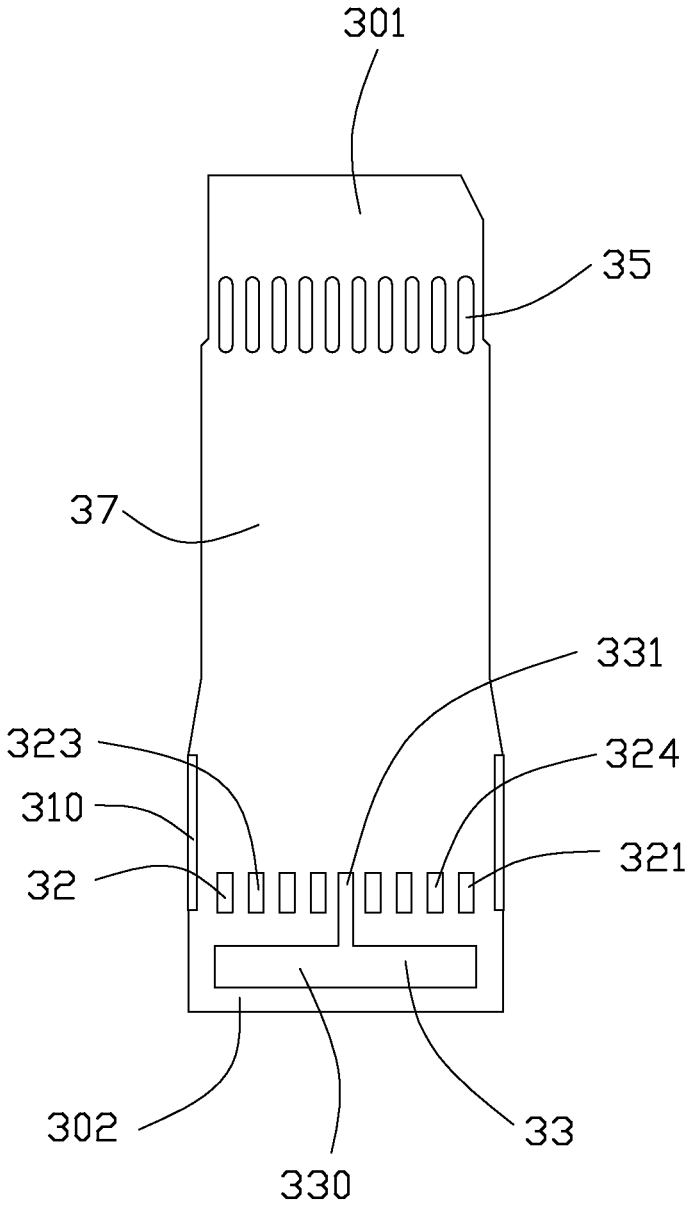
FIG. 6 is a bottom view showing the inner board as shown in FIG. 4.
Figure 7:
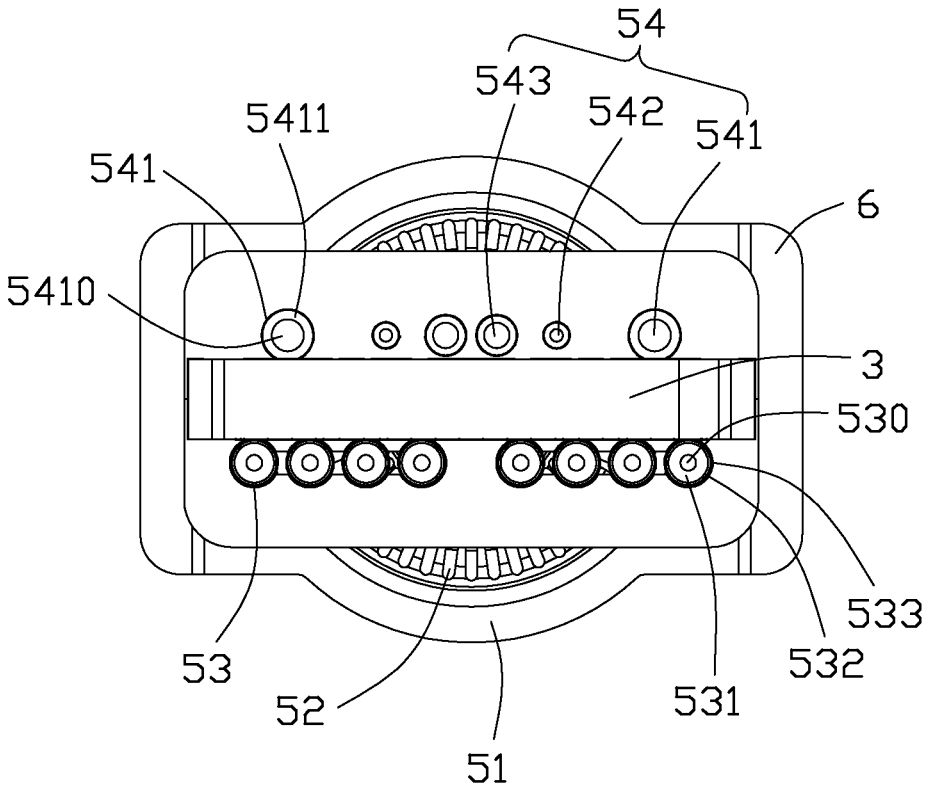
FIG. 7 is a partially cross-section view showing the arrangement of a cable as shown in FIG. 2.

Referring to FIGS. 3 and 4, the cover 8 includes a top cover 81 and a bottom cover 82. The top cover 81 and the bottom cover 82 are coupled together for defining an outer cavity 800 adapted for receiving the shielding cage 7. The top cover 81 has a number of mounting holes 811. The bottom cover 82 has a number of mounting post 821. Each of the mounting posts 821 is adapted to be received in each of the mounting holes 811 by interference fitting, such that the top cover 81 and the bottom cover 82 are assembled together. In another embodiment, the mounting post 821 and the mounting hole 811 could be hot welded together.

The shielding cage 7 includes a top cage 71 and a bottom cage 72 coupled together. The top cage 71 has a pair of side walls 712 and a top wall 710 between the side walls 712. The side wall forms at least one protrusion 7122 thereon. The bottom cage 72 has a pair of side walls 720 and a bottom wall 724 therebetween. The side wall 720 of the bottom cage forms at least one notch 722 thereon. The protrusions 7122 are respectively received in the notches 722, hence the bottom cage 72 is fixed into the top cage 71. The side wall 720 of the bottom cage 72 has a spring tab 723 elastically resisted on the side wall 712 of the top cage 71. The top wall 710 has a hole portion 7124 adapted to position a bulge 810 formed on the top cover 81. The bottom wall 724 has a hole portion 7240 adapted for positioning a bulge 820 formed on the bottom cover 82. Furthermore, the top cage 71 has a U-shaped first tail portion 7121 adapted to be riveted together with a second tail portion 721 extending from the bottom cage 72. Thus, the shielding cage 7 is assembled in the cover 8 stably. The top cage 71 and the bottom cage 72 are coupled together for defining an inner cavity 700 therein.

Referring to FIGS. 3 to 6, the inner board 3 is assembled into the inner cavity 700. The inner board 3 has a front portion 301 configured for mounting a contact module 10 and a rear portion 302 configured for connecting with the cable 5. The inner board 3 further has a top surface 38, a bottom surface 37, and a pair of side surface 31. The contact module 10 includes a housing 1 and a plurality of contacts 2 assembled into the housing 1. The housing 1 includes a main portion 11 and a pair of tongue portions 12. The pair of tongue portions 12 extend out of the main portion 11 to define a mating slot 112 therebetween configured for mating with an external board (not shown) of the above-mentioned plug connector. The housing 1 is surrounded by the mating port 71 of the shielding cage 7.

The top surface 38 has a plurality of first pads 34 which are arranged in a row along a transverse direction adjacent to the rear portion 302, and a plurality of third pads 36 arranged in a row along a transverse direction adjacent to the front portion 301. The first pads 34 include a pair of power pads 341, a pair of low frequency signal pads 342 positioned between the power pads 341, and a third ground pad 343 formed between the low frequency signal pads 342.

The bottom surface 37 has a plurality of second pads 32 which are arranged in a row along the transverse direction and adjacent to the rear portion 302, and a T shaped second ground pad 33 which has a base portion 330 extending along the transverse direction. The second ground pad 33 is positioned between the second pads 32 and the rear portion 302 and further has a nose portion 331 extending along a longitudinal direction into the second pads 32. The second pads 32 include a number of differential pair pads 321 which are equally divided into two regions by the nose portion 331. The differential pair pads 321 include a transmit differential pair 323 and a receive differential pair 324 separately located on both sides of the nose portion 331.

Figure 8:
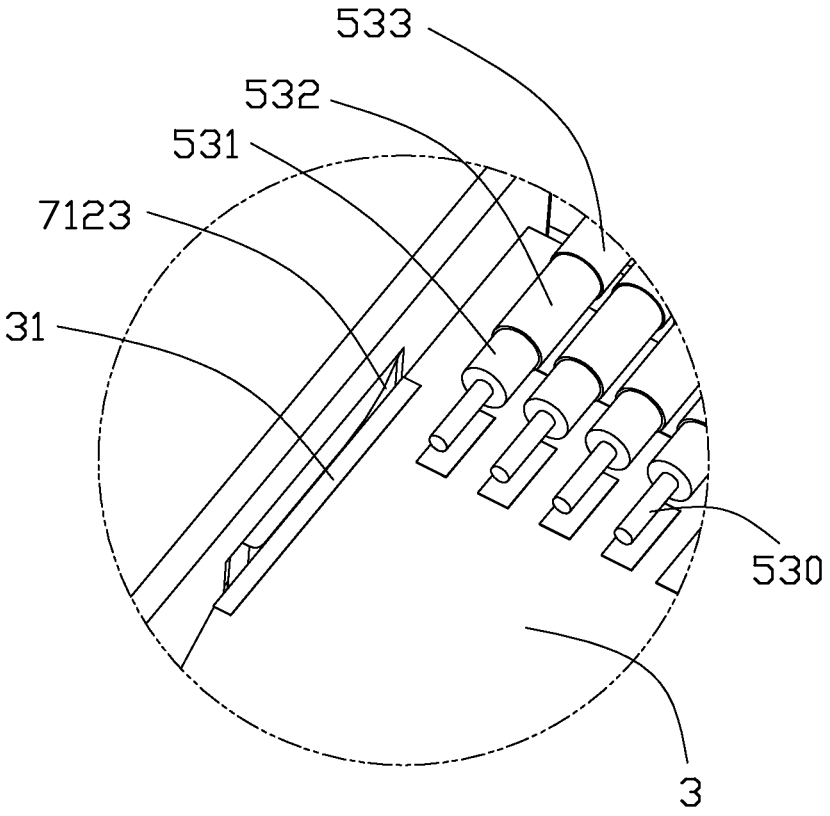
FIG. 8 is an enlarged perspective view showing a shielding cage contacting with a side surface of the inner board as shown in FIG. 2.

The inner board 3 has a pair of first ground pads 310 disposed on each side surfaces 31. The top cage 71 has a resilient rib 7123 inwardly extending from the side wall 712 for resiliently contacting with the first ground pads 310 as shown in FIG. 8, and therefore the inner board 3 and the shielding cage 7 have a same ground level. The resilient rib 7123 and the top cage 71 are integrally punched from a sheet metal in this embodiment.

The cable 5 has a number of first wires 53, a number of second wires 54, a braid layer 52 surrounding both of the first wires 53 and the second wires 54, and a jacket 51 surrounding the braid layer 52. The braid layer 52 partially exposes out of the jacket 51 and is bent to surround a part of the jacket 51 and molded into the boot 6. The first wires 54 are arranged into a row by an upper stabilizer 41 which has a number of through holes 410 adapted to receive each of the second wires 54. The first wires 54 include a pair of power wires 541 each soldered to a corresponding one of the power pads 341, a low frequency signal pair 542 soldered to the low frequency signal pads 343, and at least one ground wire 543 adapted to be soldered to the third ground pad 343.

The second wires 53 are arranged into a row by a lower stabilizer 42 which has a number of through holes 420 to receive each second wires 53. The second wire 53 has a conductor 530, an inner coat 531 surrounding the conductor 530, a ground layer 532 surrounding the inner coat 531, and an outer coat 533 surrounding the ground layer 532. The ground layer 532 partially exposes out of the outer coat 533, therefore the ground layer 532 could be soldered onto the base portion 330 of the second ground pad 33. The conductor 530 partially exposes out of the inner coat 531, and therefore the conductor 530 can be soldered onto the second pads 32 separately. The second wires 53 are configured for transmitting differential signals.

The upper stabilizer 41 and the lower stabilizer 42 have respective posts 412,421 and apertures 411,422. Thus, the upper stabilizer 41 and lower stabilizer 42 can be stacked together by inserting the post 412,421 into the aperture 422, 411. Hence, the cable 5 is conveniently soldered to the inner board 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

a cover including a top cover and a bottom cover coupled together and defining an outer cavity therebetween;

a shielding cage including a top cage and a bottom cage coupled together and defining an inner cavity therebetween, said shielding cage mounted into the outer cavity and having a mating port exposed out of the cover;

an inner board mounted into the inner cavity, said inner board having a front portion, a rear portion opposite to the front portion, a top surface, a bottom surface, and two side surfaces, said top surface having a plurality of first pads adjacent to the rear portion, said bottom surface having a plurality of second pads adjacent to the rear portion, and one of said side surfaces having a first ground pad thereon;

a cable having a jacket and a plurality of wires shrouded by the jacket, each wire having an outer coat and a conductor partially exposed out of the outer coat, said wires including a plurality of power wires soldered to the first pads, and a plurality of differential signal wires soldered to the second pads; and a resilient rib inwardly extending from one of the top cage and the bottom cage, said resilient rib resiliently and electrically contacting with the first ground pad.

2. The cable assembly as claimed in claim 1, further including a contact module assembled to the front portion of the inner board and surrounded by the mating port of the shielding cage, said contact module including an insulator, a plurality of upper contacts mounted into the insulator and soldered to the top surface adjacent to the front portion of the inner board, and a plurality of lower contacts mounted into the insulator and soldered to the bottom surface adjacent to the front portion of the inner board.

3. The cable assembly as claimed in claim 2, wherein the top surface has a plurality of third pads adjacent to the front portion of the inner board, the bottom surface has a plurality of fourth pads adjacent to the front portion of the inner board, and each of the upper contacts and the lower contacts has a mounting portion soldered to a corresponding one of the third pads and the fourth pads, a mating portion extending into the mating port, and a middle portion mounted into the insulator to interconnect the mating portion and the mounting portion.

4. The cable assembly as claimed in claim 3, wherein the mating portions of the upper contacts and the lower contacts are positioned in generally opposing relationships so as to provide a mating slot.

5. The cable assembly as claimed in claim 1, wherein the bottom surface has a second ground pad, said second ground pad having a base portion extending along a transverse direction between the rear portion and the second pads and a nose portion extending along a longitudinal direction into said second pads.

6. The cable assembly as claimed in claim 5, wherein the second pads are equally divided by the nose portion of the second ground pad.

7. The cable assembly as claimed in claim 5, wherein each of the signal wires has an inner coat surrounding the conductor and a ground layer surrounding the inner coat, said outer coat surrounding the ground layer, the ground layer partially exposed out of the outer coat and the conductor partially exposed out of the inner coat, said ground layer configured to be soldered onto the base portion of the second ground pad.

8. The cable assembly as claimed in claim 1, wherein the first pads include a pair of power pads and a third ground pad disposed between the power pads.

9. The cable assembly as claimed in claim 1, further including a boot coated on the cable and partially extending into the cover, and wherein the cable has a braid layer positioned between the jacket and the wires, said braid layer partially extending out of the jacket and bent to surround the jacket and molded into the boot.

10. The cable assembly as claimed in claim 1, wherein the conductor of the power wire has a diameter less than 0.511 mm.

11. The cable assembly as claimed in claim 1, further including an upper stabilizer adapted to organize the power wires and a lower stabilizer adapted to organize the signal wires, the upper stabilizer having a post and the lower stabilizer having an aperture, said upper stabilizer and lower stabilizer stacked together by inserting the post into the aperture.

12. A cable connector assembly comprising:

a metallic case;

a printed circuit board disposed in the case and defining thereof opposite front mating port and rear connecting port in a front-to-back direction, and defining thereon opposite first and second surfaces in a vertical direction perpendicular to said front-to-back direction;

in the rear connecting port and on the first surface, a first group of differential pair pads and a second group of differential pair pads being symmetrically formed with regard to a center line of the printed circuit board which extending along the front-to-back direction, an enlarged grounding pad located behind the first and second groups of differential pair pads and extending along a transverse direction perpendicular to both said front-to-back direction and said vertical direction;

in the rear connecting port and on the second surface, a pair of power pads being formed on two opposite sides, along the transverse direction, with therebetween a center grounding pad located in the center line, and a pair of signal pads each between the center grounding pad and the corresponding power pad; and a plurality of differential pair wires, grounding wires, power wires and signal wires being mechanically and electrically connected to the corresponding differential pair pads, grounding pads, power pads and signal pads, respectively.

13. The cable connector assembly as claimed in claim 12, wherein on the second surface, the power pad is larger than the grounding pad, and the grounding pad is larger than the signal pad.

14. The cable connector assembly as claimed in claim 12, wherein on the first surface, said enlarged grounding pads further includes a slender section extending along the center line to separate the first group of differential pair pads and the second group of differential pair pads from each other along said transverse direction.

15. The cable connector assembly as claimed in claim 12, wherein said printed circuit board further includes a pair of side grounding pads on two opposite side edges thereof, said side grounding pad unifying paralleled grounding layers in the printed circuit board and electrically and mechanically connected by a resilient rib extending from the case.

16. The cable connector assembly as claimed in claim 15, wherein said pair of side grounding pads are located in the rear connecting port, and in said transverse direction a dimension of the front mating port is smaller than that of the rear connecting port.

17. The cable connector assembly as claimed in claim 12, further including a terminal module electrically and mechanically connected to the front mating port to form a receiving cavity in the terminal module for receiving a plug connector.

18. The cable connector assembly as claimed in claim 12, wherein the differential pair pads, the signal pads, the grounding pads and the power pads are not symmetrically arranged on said two opposite first and second surface while being symmetrically arranged with the center line on each of said opposite first ands second surfaces.

19. A cable connector assembly comprising:

a metallic case;

a printed circuit board received with the case and defining opposite first and second surfaces in a vertical direction and opposite front mating port and rear connecting port in a front-to-back direction perpendicular to said vertical direction;

a plurality of signal pads, differential pair pads, grounding pads and power pads being commonly formed on both said opposite first and second surfaces;

a plurality of signal wires, differential pair wires, grounding wires and power wires being soldered upon the corresponding signal pads, differential pair pads, grounding pads and power pads, respectively; and a pair of lateral side grounding pads formed on two opposite side edges of the printed circuit board and mechanically and electrically connected to paralleled grounding layers in the printed circuit board; wherein the case forms projections on two lateral sides to mechanically and electrically connect the corresponding lateral side grounding pads, respectively.

20. The electrical cable connector assembly as claimed in claim 19, wherein each of said lateral side grounding pads extends into the opposite first and second surfaces with a distance, respectively.

* * * * *